US007285315B2

(12) United States Patent
Fragola

(10) Patent No.: US 7,285,315 B2
(45) **Date of Patent: *Oct. 23, 2007**

(54) CLOSURE IN SYNTHETIC MATERIAL FOR CONTAINERS

(75) Inventor: Felice Fragola, Alessandria (IT)

(73) Assignee: Guala Dispensing, S.p.A., Alessandria (IT)

( * ) Notice: Subject to any disclaimer, the term of this patent is extended or adjusted under 35 U.S.C. 154(b) by 187 days.

This patent is subject to a terminal disclaimer.

(21) Appl. No.: 10/466,038

(22) PCT Filed: Jul. 17, 2001

(86) PCT No.: PCT/IT01/00377

§ 371 (c)(1),
(2), (4) Date: Oct. 20, 2003

(87) PCT Pub. No.: WO02/055401

PCT Pub. Date: Jul. 18, 2002

(65) Prior Publication Data

US 2005/0031869 A1 Feb. 10, 2005

(30) Foreign Application Priority Data

Jan. 16, 2001 (EP) ..... 01830021

(51) Int. Cl.
*B32B 3/12* (2006.01)

(52) U.S. Cl. ..... 428/158; 428/159; 428/195.1; 428/403; 428/446; 428/447; 428/455; 428/402.24; 215/364; 215/212; 215/208; 215/200; 521/81; 524/277; 524/270; 524/413; 430/16; 430/346; 252/301.35

(58) Field of Classification Search ..... 252/301.35; 428/402.24, 195.1, 403, 446, 447, 455, 158, 428/159; 430/346, 16; 524/277, 270, 413; 215/200, 208, 212, 364
See application file for complete search history.

(56) References Cited

U.S. PATENT DOCUMENTS

| | | | | |
|---|---|---|---|---|
| 4,664,275 | A * | 5/1987 | Kasai et al. | 215/247 |
| 5,060,818 | A | 10/1991 | Doi et al. | |
| 5,381,914 | A * | 1/1995 | Koyama et al. | 215/341 |
| 5,487,920 | A * | 1/1996 | Lopata et al. | 427/489 |
| 5,496,862 | A | 3/1996 | Burns | |
| 5,608,429 | A * | 3/1997 | Hayashihara et al. | 346/135.1 |
| 5,668,225 | A | 9/1997 | Okazaki et al. | |
| 5,868,264 | A * | 2/1999 | Fulford et al. | 215/232 |

(Continued)

FOREIGN PATENT DOCUMENTS

| | | |
|---|---|---|
| WO | WO 98/31521 | 7/1998 |

(Continued)

*Primary Examiner*—Rena Dye
*Assistant Examiner*—Tamra L. Dicus
(74) *Attorney, Agent, or Firm*—Kalow & Springut LLP; John J. Santalone

(57) ABSTRACT

The present invention relates to a closure which is made of synthetic material with characteristics similar to or even better than those of cork and which can therefore be used in all applications in which a cork closure is normally used. In particular, the closure according to the present invention is a stopper for containers for wine or liquors.

In particular, the present invention relates to a container closure made of an expanded elastomer by means of a thermal molding method, characterized in that the expanded elastomer can be produced by means of a step of expansion by a supercritical fluid.

16 Claims, 2 Drawing Sheets

U.S. PATENT DOCUMENTS

| | | | | |
|---|---|---|---|---|
| 5,904,965 | A | 5/1999 | Noel et al. | |
| 5,934,503 | A * | 8/1999 | Shachi et al. | 221/154 |
| 5,955,163 | A * | 9/1999 | White | 428/35.7 |
| 5,976,411 | A * | 11/1999 | Feng et al. | 252/301.35 |
| 6,022,905 | A * | 2/2000 | Harris et al. | 522/2 |
| 6,216,898 | B1 * | 4/2001 | Aberdein et al. | 215/355 |
| 6,303,666 | B1 * | 10/2001 | Yorita et al. | 521/79 |
| 6,355,320 | B1 * | 3/2002 | Allman et al. | 428/36.5 |
| 6,376,059 | B1 * | 4/2002 | Anderson et al. | 428/314.8 |
| 6,592,949 | B1 * | 7/2003 | Polke et al. | 427/553 |
| 6,706,223 | B1 * | 3/2004 | Anderson et al. | 264/51 |
| 6,733,706 | B2 * | 5/2004 | Allman et al. | 264/50 |
| 6,796,449 | B2 * | 9/2004 | Fragola | 215/364 |
| 2001/0036537 | A1 * | 11/2001 | Jux et al. | 428/195 |

FOREIGN PATENT DOCUMENTS

| | | |
|---|---|---|
| WO | WO 00/23259 | 4/2000 |
| WO | WO 00/74073 | 12/2000 |

* cited by examiner

CLOSURE IN SYNTHETIC MATERIAL FOR CONTAINERS

FIELD OF THE INVENTION

The present invention relates to a closure which is made of synthetic material with characteristics similar to or even better than those of cork and which can be used in all applications in which a cork closure is normally used. In particular, the closure according to the present invention is a stopper for containers for wine or liquors.

BACKGROUND ART

Cork is the material which, by virtue of its properties of corrosion resistance, resilient return after compression—which enables the closure to form a good seal—and impermeability to gases, is normally used for the manufacture of stoppers for medium-quality and good-quality wine bottles.

However, cork is a material of natural origin and, as such, is subject to some disadvantages which render its use ever less desirable. In the first place, its high cost, particularly for good-quality cork stoppers, combined with the fact that it is difficult to obtain, tend to confine its use ever more to good-quality wines or liquors. In the second place, precisely because cork is a natural material, its properties are subject to considerable variability. As a result, a considerable percentage of wine bottles have to be discarded owing to defects of closure such as leakage of liquid or the characteristic and unpleasant "corked flavour" conferred on the wine by a poor-quality cork stopper. A poor-quality cork stopper also tends to crumble when removed, thus contaminating the contents of the bottle.

Wine stoppers made of synthetic material are already known. They may be made of various materials, particularly of elastomers such as expanded polyethylene or copolymers thereof, polystyrene and copolymers thereof, EVA, polyurethanes, polypropylenes, and so on. However, although known stoppers have some characteristics which render them similar to conventional cork stoppers, such as good resilient return after compression and good impermeability to gases, they still have some disadvantages which may make their use inadvisable.

In particular, United States patent U.S. Pat. No. 5,496,862 in the name of Supreme Corq describes stoppers made of a thermoplastic elastomer, that is, styrene-ethylene-butylene-styrene (SEBS), in which the expansion of the material is brought about by the addition of a chemical expanding agent in a quantity of between approximately 3% and 5% by weight, calculated relative to the weight of the composition. Although the expanding agent generates gas during the expansion of the polymer and is therefore partially eliminated from the final product, a certain amount of expanding agent inevitably remains in the stopper in unreacted form or as a degradation product. This is certainly disadvantageous since it may lead to contamination of the contents of the bottle.

The same patent cited above also describes the possibility of printing captions on the stopper with ink. If these inscriptions are produced on the surface of the stopper which comes into contact with the neck of the bottle or with the wine—which practice is ever more widespread in the field—once again, the contents of the bottle may be contaminated by the stopper.

There is therefore a considerable demand for container closures which are made of synthetic material but which have characteristics similar to those of a cork stopper—that is, good resilient return after compression, good impermeability to gases, and the ability to be removed with corkscrews in conventional manner—without, however, having the disadvantages of cork closures or of those made of plastics material according to the prior art, in particular, the possible transfer of contaminating materials or substances to the contents of the bottle.

SUMMARY OF THE INVENTION

The problem underlying the present invention is therefore that of providing a container closure having the characteristics described above.

This problem is solved by a container closure made of synthetic material as defined in the appended claims.

Further characteristics and advantages of the closure of the present invention will become clearer from the description of some preferred embodiments given below, by way of non-limiting example, with reference to the drawings.

DETAILED DESCRIPTION OF THE INVENTION

Figure 1:
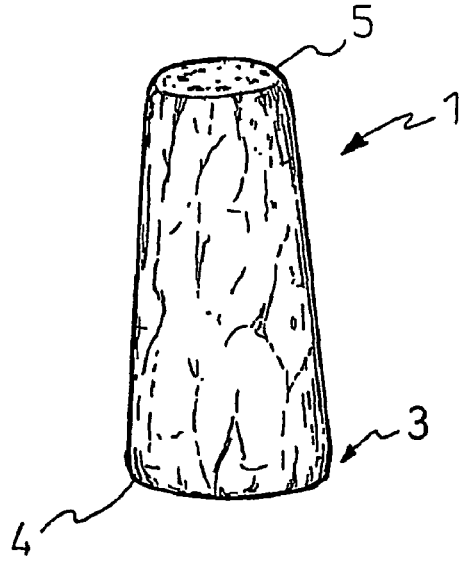
FIG. 1 is a perspective view of a stopper according to the present invention.
Figure 2:
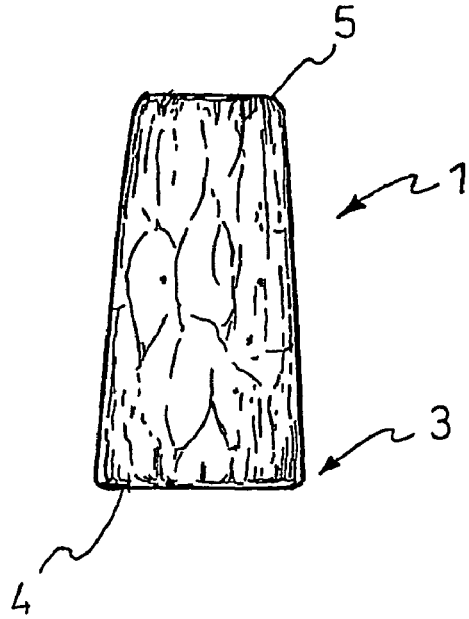
FIG. 2 shows the stopper of FIG. 1 in section.

A specific embodiment of the closure according to the present invention is shown in the drawings, in which the stopper, generally indicated 1, is substantially frustoconical but with a lateral surface which does not have a marked inclination. The larger-diameter portion 3 is intended to be inserted in the neck of the container. In this way, and by virtue of its shape, it can exert a greater sealing pressure against the inner walls of the container neck, particularly in the vicinity of the area of possible contact with the liquid, thus maximizing the leaktightness of the closure.

The inner rim 4 of the stopper 1 which defines the junction between the lateral surface and the lower surface of the stopper—that is to say, the surface which is to be inserted in the container neck—is rounded so as to facilitate the insertion of the stopper. Naturally, there is nothing to prevent the outer rim 5 from also being rounded. In this case, this facilitates the insertion of the stopper in an inverted position by the consumer who, once the bottle has been uncorked, and without the availability of a suitable corking device, would have serious difficulty in reinserting the stopper in the correct initial position.

Figure 3:
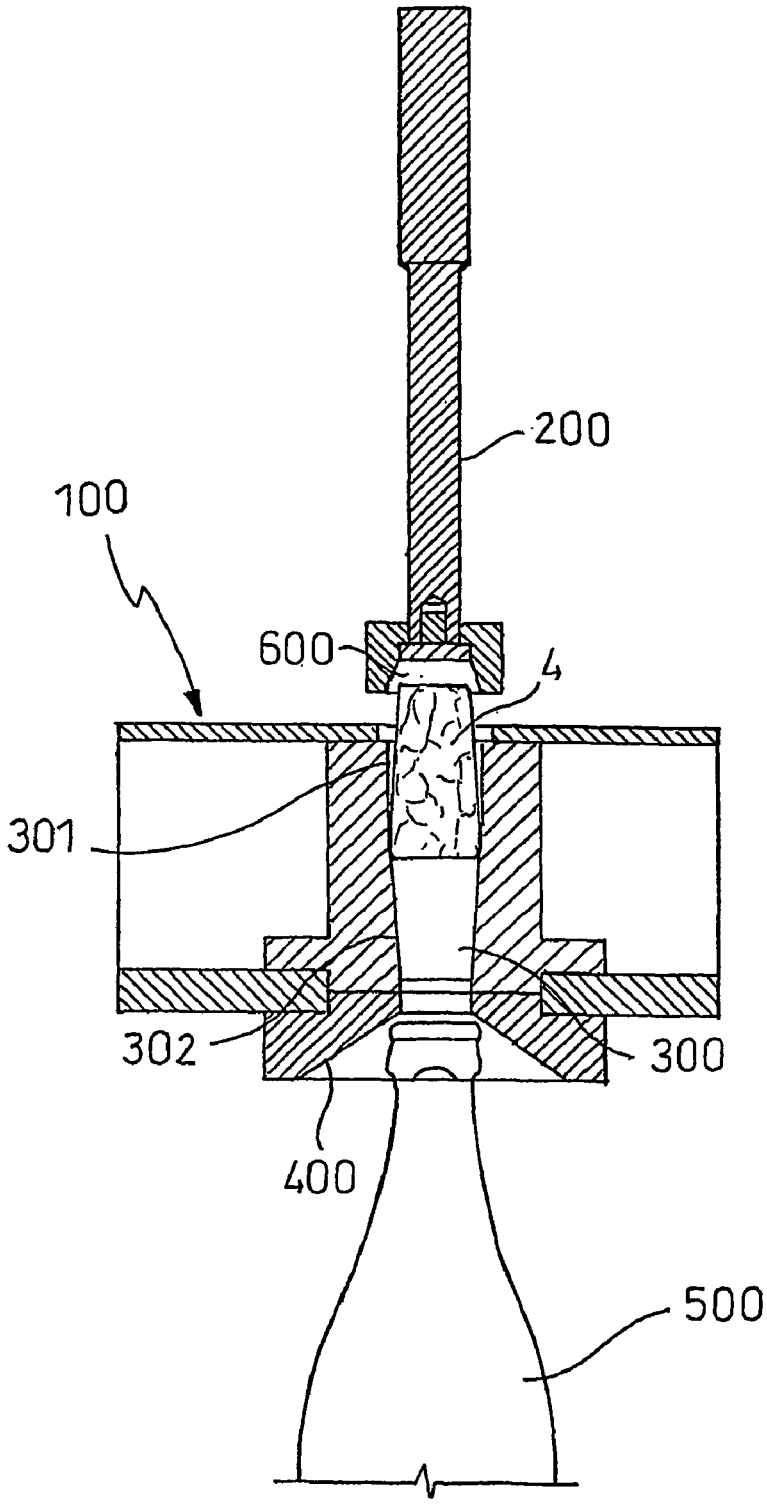
FIG. 3 is a schematic view showing, in section, a detail of a corking machine usable with the stoppers according to the present invention.

FIG. 3 shows a corking head 100 of a corking machine on which a corking piston 200 acts. The corking head 100 has a through-hole 300 arranged in alignment with the seat 400 for holding the neck of the container 500. The corking piston 200, which is provided with means 600 for engagement with the stopper 1, is in turn arranged in alignment with the hole 300.

The hole 300 has a substantially cylindrical upper portion 301 and a downwardly-tapered, frustoconical lower portion 302. The diameter of the upper portion 301 is substantially equal to the larger diameter of the stopper 1. The smaller diameter of the lower, frustoconical portion 302 of the hole, on the other hand, is substantially equal to or slightly less than that of the mouth of the container 500.

During corking, the stopper 1 is inserted in the hole 300 of the corking head 100 under the thrust of the piston 200. When the stopper has passed through the upper cylindrical portion 301 of the hole 300, it starts to engage the lower portion 302 of the hole and reacts against the walls of the hole so as to be pre-compressed progressively until, at the output, it adopts a diameter substantially equal to or slightly smaller than that of the mouth of the container 500 to be corked. The corking operation is thus considerably facilitated.

The following description of the closure according to the present invention should not be understood as being limited to the stopper shown in the drawings, but may be applied to any closure for containers, whatever its shape or its field of use.

The closure according to the present invention is made of a plastics material which has good mechanical characteristics—in particular, with good resilient return after compression—and good chemical/physical characteristics such as impermeability to gases and which, moreover, does not have a tendency to transfer toxic substances or unpleasant odours to the contents of the bottle.

Plastics materials which may be used for the closure according to the present invention are selected from expanded elastomers of the styrene-based block copolymers, the hydrogenated styrene-based block copolymers, the mixtures of these block copolymers with polyolefins, or the silicones.

The term "styrene-based block copolymers" is intended preferably to define herein styrene-butadiene, styrene-butadiene-styrene, styrene-isoprene-styrene, and styrene-ethylene-butylene-styrene block copolymers.

The term "hydrogenated styrene-based block copolymers" is intended preferably to define herein styrene butadiene, styrene-butadiene-styrene, styrene-isoprene-styrene and styrene-ethylene-butylene-styrene block copolymers, even more preferably styrene-butadiene block copolymers, having a degree of hydrogenation greater than 70%, preferably greater than 90%.

The term "polyolefins" is intended preferably to define herein polymers selected from low-density, medium-density, or high-density polyethylene, polypropylene, or their copolymers, ethylene-propylene-butene, and ethylene-vinyl acetate.

Hydrogenated styrene-based block copolymers which are particularly preferred are those described in Japanese patent application JP S57-13360 in the name of Japan Crown Cork Co. Ltd. The description of this patent application, insofar at it relates to the compositions of the hydrogenated copolymers and to their production, is incorporated herein by reference.

Silicones which are preferred for the purposes of the present invention are LSR (liquid silicone rubber) silicones, even more preferably two-part LSR silicones. Particularly preferred examples of these silicones are Silopren® LSR from Bayer and Silastic®.

The plastics material according to the present invention must be expanded so as to cause them to adopt the necessary mechanical properties, particularly the resilience, required for good leaktightness of the closure.

The polymeric material is expanded by the addition of an expanding agent which can generate gas in the conditions of the thermoplastic moulding of the closure. As stated above, the expanding agents used in the prior art are of a chemical nature and may therefore leave toxic residues in the expanded material; however, this is to be avoided in a closure which is intended to come into contact with beverages.

To prevent this problem, the inventors of the present invention have established a method for the thermal moulding of the closure which provides for the use of a fluid in the supercritical phase, as an expanding agent. As is known, a fluid which is in the supercritical phase is a fluid which is kept at a pressure and at a temperature that are greater than the critical pressure and temperature of that material, so that the fluid adopts characteristics both of a liquid and of a gas. For example, the fluid will have a dissolving power similar to that of a liquid but a surface tension considerably lower than that of a liquid and such as to increase its diffusion within the solute.

The method according to the present invention provides for the following steps:

(a) providing a source of a supercritical fluid at a temperature and at a pressure greater than the critical temperature and pressure of the supercritical fluid, (b) preheating the polymeric material to a temperature above the critical temperature of the supercritical fluid, preferably to the softening point or melting point of the polymeric material, (c) saturating the polymeric material, preheated in step (b), with the supercritical fluid, whilst maintaining a temperature and a pressure greater than the critical temperature and pressure of the supercritical fluid in the saturation chamber, preferably mixing the preheated polymeric material and the supercritical fluid in the chamber so as to facilitate the saturation process, (d) injecting the polymeric material, preheated and saturated with the supercritical fluid, into a mould for closures, reducing the pressure to a pressure below the critical pressure of the supercritical fluid, and (e) keeping the polymeric material in the mould until the forming of the closure is completed.

The preferred supercritical fluid for the method defined above is nitrogen in the supercritical phase, the critical temperature and pressure of which are T=approximately −147° C. and P=approximately $3.389\times10^6$ N/m$^2$, respectively.

The percentage of supercritical fluid used, relative to the weight of the polymeric mixture to be expanded, will depend on various factors such as the type of material used, the type of supercritical fluid selected, and the conditions for the injection and moulding of the stopper. The percentage of supercritical fluid preferably varies between 0.07% and 0.5%. Even more preferably, the percentage of supercritical fluid will be between 0.14% and 0.20%, relative to the weight of the polymeric mixture to be expanded.

According to a preferred aspect of the present invention, the polymeric mixture will be further supplemented with additives of various kinds such as, for example, pigments or additives which can permit a greater uniformity of expansion of the material.

In step (d), the mould will preferably be provided with gas-discharge valves. When the polymeric material, preheated and saturated with the supercritical fluid, is injected into the mould, this material will thus pass rapidly from the initial pressure and temperature to ambient pressure and temperature. The supercritical fluid will thus be in conditions of thermodynamic instability and will give rise to the formation of micro-bubbles of gas which will bring about expansion of the polymeric material. The change of the supercritical fluid from the supercritical state to the gaseous state will bring about a sudden reduction in temperature so that the polymeric material will tend to set quickly in the mould.

After the step of injection into the mould, the polymeric material will have to remain in the mould for a period of time sufficient for the completion of the expansion and forming (cooling) of the stopper. For styrene-ethylene-butylene-styrene copolymer expanded with nitrogen in the supercritical phase, this forming time will generally be less than 1 minute, preferably less than 30 seconds.

The apparatus for implementing the method described above consists of a source of supercritical fluid and of a station for the preheating of the polymeric material, the source of supercritical fluid and the preheating station being connected to a station for the saturation of the polymeric material with the supercritical fluid. The saturation station is then connected to the mould by means of suitable injectors. This apparatus, which will not be described in greater detail herein, is of known type and is described, for example, in WO98/31521, the description of which is incorporated herein by reference.

It is clear that the use of a supercritical fluid as an expanding agent prevents toxic residues remaining in the polymeric material, as occurs with a chemical expanding agent.

A further advantage of the method of expansion with fluids in the supercritical phase lies in the fast speed of injection of the thermoplastic material during the thermal moulding stage. This fast injection speed minimizes temperature variations in the mould, which translates into a more homogeneous density of the material and prevents the formation of numerous junction lines, even within the piece.

The inventors of the present patent application have also surprisingly found that the method of the invention produces an expanded material which has a microcellular structure with closed cells and with cell dimensions much smaller than can be achieved with expanding agents of other types, and with a more homogeneous distribution of the cells than in materials produced with the other expanding agents. This characteristic translates into improved mechanical properties (resilience) and chemical/physical properties (impermeability to gases) of the closure.

In the material expanded by the method of the present invention, the average cell size is less than 2 microns and a density of from $10^9$ to $10^{12}$ cells per $cm^3$ is thus obtained.

As stated above, a further problem which the present invention aims to solve is that connected with the potential toxicity of the inks used for printing inscriptions or captions on the sides of the stopper.

It has been found that marking of the surface of the closure according to the present invention can be achieved, without the aid of potentially toxic substances, by means of a method which provides for the treatment of the surface of the closure with a laser beam. The principle on which this treatment is based is that of bringing about sudden and intense heating of the surface to be marked. According to a first method, this heating brings about instantaneous carbonization of the molecules of plastics material which consequently adopt a dark coloration. Naturally, it is essential for this carbonization to be highly directional, that is, to take place solely in the area which is actually to be covered by the inscription. Naturally, the only instrument which can bring about such intense and directional heating is a laser.

A second method, however, provides for the addition, to the expanded material to be marked, of an additive which can change colour when struck by the laser beam. This additive is called a "toning master".

The type of laser and the energy necessary for this marking process will depend on the plastics material to be marked. For the material used in the closures of the present invention, a NdYAG laser having a power of from 30 to 200 Watts and a wavelength of 1064 nm (secondary waves 532-355-266 nm) is generally preferred. The working frequency will generally be between 0.1 and 15 kHz, preferably 5 kHz. The laser amperage may vary from 5 to 25 A, 5 A being the preferred amperage. The scanning speed will vary between 150 and 350 mm/sec, preferably 300 mm/sec.

The plastics material of which the stopper is composed will have to be supplemented with a toning master which can change colour when struck by the laser beam. A preferred master is an EVA-based polymer supplemented with mica. A particularly preferred toning master is SAMARTENE® from Clariant. The toning master is added to the polymeric mixture of the closure in quantities of between 1% and 4%, preferably approximately 2%. The selection of a laser marking method which provides for the use of a toning master rather than laser methods which provide for the production of the inscriptions by surface carbonization, is preferred. In fact, for a closure for containers in which leaktightness is essential, inscriptions produced by surface carbonization may lead to unacceptable surface irregularities. These surface irregularities would not therefore permit the adhesion to the inner surface of the container neck which is necessary to ensure leaktightness of the closure.

The apparatus for implementing the method is of known type and commercially available and will not therefore be described in further detail.

Further advantages of the laser marking method according to the present invention are better resolution of the printed characters and consequently a larger amount of information marked per unit of area. Moreover, laser-printed inscriptions have a longer life and better wear resistance, which are qualities that are particularly important for closures for containers in which the inscriptions are produced on the very surface which is subject to greatest friction during corking and uncorking.

Naturally, the marking of the closures by a laser method may equally well be applied, after suitable modifications, to closures made of materials other than those used in the present invention and, in particular, to other plastics materials or to cork.

A third aspect of the present invention is that of providing the surface of the closure with a barrier effect towards chemical/physical attack coming both from the exterior and from the interior of the closure. In particular, it is important to maximize impermeability to gases, even with the use of materials which do not have this characteristic per se.

This object is achieved by covering the surface of the closure with a protective film. The technology used for the deposition of this protective film is that known as PECVD, which provides for the deposition of the material by a gas in the plasma state. It is known that, when a gas becomes plasma, it is partially ionized. The ions of the gas thus acquire considerable reactivity such as to modify the chemical/physical characteristics of the surface with which they come into contact. The treatment with gas in the plasma state is performed at temperatures close to ambient temperature and at pressures of 0.01-1 mbar, with the use of radio frequencies or continuous electrical discharge to generate the plasma. This method enables materials of any type, from metal alloys to polymers, to be treated.

The thin film with which the closure according to the invention is covered may be of various types and is composed of monomers which tend to ionize in the treatment conditions, triggering the polymerization and film-forming stage.

The preferred material is a quartz with added carbon, of the formula:

$Si_xO_yC_zH_w$ in which X varies between 1.5 and 2.2 and Y varies between 0.15 and 0.80.

The thickness of the film deposited generally varies between 0.1 and 10 microns.

The particular characteristics of the film formed by this method are that it adheres strongly to the substrate and protects the material from corrosion but, above all, ensures a good barrier. This plasma treatment may also be applied to closures made of plastics materials other than those used for the present invention, conferring on them improved chemical/physical properties and, in particular, improved impermeability to gases, as well as to cork closures. In this latter case, the plasma deposition treatment has a further advantage, that is, that of preventing leakage of the pathogenic agents already present in the cork (moulds and fungi) which may contaminate the product.

The invention claimed is:

1. A wine bottle stopper made of an expanded elastomer selected from the group consisting of styrene-based block copolymers, hydrogenated styrene-based block copolymers and mixtures thereof with polyolefins, the wine bottle stopper being made by means of a thermal moulding method, wherein the expanded elastomer is produced by expanding a polymeric material with nitrogen in its supercritical state, the thermal moulding method comprising the steps of:

(a) providing a source of supercritical nitrogen at a temperature and at a pressure greater than the critical temperature and pressure of the supercritical nitrogen, (b) preheating the polymeric material to a temperature above the critical temperature of the supercritical nitrogen, preferably to the softening point or melting point of the polymeric material, (c) saturating the polymeric material, preheated in step (b), with the supercritical nitrogen whilst maintaining a temperature and a pressure greater than the critical temperature and pressure of the supercritical nitrogen in a saturation chamber, preferably mixing the preheated polymeric material and the supercritical nitrogen in the chamber so as to facilitate the saturation process, (d) injecting the polymeric material, preheated and saturated with the supercritical nitrogen, into a mould for wine bottle stoppers, reducing the pressure to a pressure below the critical pressure of the supercritical nitrogen, and (e) keeping the polymeric material in the mould until the forming of the stopper is completed.

2. A wine bottle stopper according to claim 1, in which the styrene-based block copolymers are styrene-butadiene, styrene-butadiene-styrene, styrene-isoprene-styrene, and styrene-ethylene-butylene-styrene block copolymers.

3. A wine bottle stopper according to claim 1 in which the hydrogenated styrene-based block copolymers are styrene butadiene, styrene-butadiene-styrene, styrene-isoprene-styrene and styrene-ethylene-butylene-styrene block copolymers, most preferably styrene-butadiene block copolymers, having a degree of hydrogenation greater than 70%, preferably greater than 90%.

4. A wine bottle stopper according to claim 1 in which the polyolefins are polymers selected from low-density, medium-density or high-density polyethylene, polypropylene, or their copolymers, ethylene-propylene-butene and ethylene-vinyl acetate.

5. A wine bottle stopper according to claim 1 in which the supercritical fluid is added to the polymeric mixture in quantities of between 0.07% and 0.5% by weight.

6. A wine bottle stopper according to claim 5 in which the percentage of the supercritical fluid added to the polymeric mixture is between 0.14% and 0.2% by weight.

7. A wine bottle stopper according to claim 1 in which the polymeric material is composed of cells whose average size is less than 2 microns.

8. A wine bottle stopper according to claim 1 in which the polymeric material to be expanded is supplemented with one or more additives which permit greater uniformity of expansion of the polymeric material.

9. A wine bottle stopper according to claim 1 in which the outer surface of the closure is marked by a laser marking method.

10. A wine bottle stopper according to claim 9 in which the laser is an NdYAG laser, and in which the expanded elastomer is supplemented with a toning master, the toning master preferably being an EVA-based polymer supplemented with mica.

11. A wine bottle stopper according to claim 1 in which the closure is coated with a protective film which can be produced by a plasma deposition process.

12. A wine bottle stopper according to claim 11 in which the protective film is constituted by a quartz polymer of formula:

$Si_xO_yC_zH_w$ in which x varies between 1.5 and 2.2 and Y varies between 0.15 and 0.80.

13. A wine bottle stopper according to claim 12 in which the thickness of the film deposited varies between 0.1 and 10 microns.

14. A wine bottle stopper according to claim 1, the stopper being a substantially frustoconical stopper (1) with a lateral surface which does not have a marked inclination, the larger-diameter portion (3) being intended to be inserted in the neck of the container.

15. A wine bottle stopper according to claim 14 in which the inner rim (4) of the stopper (1) which defines the junction between the lateral surface and the lower surface of the stopper, is rounded.

16. A wine bottle stopper according to claim 15 in which the outer rim (5) is also rounded.

* * * * *